US005343178A

United States Patent [19]

Bagalini

[11] Patent Number: 5,343,178

[45] Date of Patent: Aug. 30, 1994

[54] ELECTRIC CIRCUIT BREAKER

[75] Inventor: Dante Bagalini, Johannesburg, South Africa

[73] Assignee: Circuit Breaker Industries Limited, Johannesburg, South Africa

[21] Appl. No.: 120,670

[22] Filed: Sep. 13, 1993

[30] Foreign Application Priority Data

Jul. 9, 1993 [ZA] South Africa ..... 93/4961

[51] Int. Cl.[5] ..... H01H 7/00

[52] U.S. Cl. ..... 335/59; 335/62

[58] Field of Search ..... 335/59, 60, 61, 62, 335/63, 64, 167–176

[56] References Cited

U.S. PATENT DOCUMENTS

| | | | |
|---|---|---|---|
| 2,764,648 | 9/1956 | Gascione et al. | 335/59 |
| 2,919,325 | 12/1959 | Brauneck | 335/59 |
| 3,900,810 | 8/1975 | Grenier | 335/62 |
| 4,062,052 | 12/1977 | Harper et al. | 335/59 |
| 5,053,736 | 10/1991 | Fasano | 335/62 |

*Primary Examiner*—Lincoln Donovan
*Attorney, Agent, or Firm*—Ladas & Parry

[57] ABSTRACT

A current monitoring assembly 12 of a circuit breaker includes a coil 16, a tube 18 slidably mounted in the coil 16, a core 20 slidably housed within the tube 18, a first pole piece 22 mounted on an end of the tube 18 and an "O"-shaped magnetic frame 24 having a second pole piece 26 aligned with the first pole piece 22. A retarding fluid is contained within the tube 18 and a core spring 46 is arranged intermediate an end of the core 20 and the pole piece 22.

8 Claims, 1 Drawing Sheet

ELECTRIC CIRCUIT BREAKER

FIELD OF THE INVENTION

This invention relates to an electric circuit breaker. More particularly, it relates to a current monitoring assembly for the circuit breaker.

SUMMARY OF THE INVENTION

According to the invention there is provided a current monitoring assembly which includes

- a tube that is of a non-magnetic material and which is slidably mounted to be movable between first and second positions;
- a coil around the tube;
- a core within the tube, the core being of a magnetic material and being slidably housed within the tube;
- a retarding fluid contained in the tube for retarding movement of the core;
- a core spring within the tube for urging the core towards a first end of the tube;
- a first pole piece mounted on the tube at a second end thereof;
- a magnetic circuit defining means, for defining a magnetic circuit around the coil, which has a second pole piece aligned with the first pole piece and being positioned relative to the first pole piece such that the first pole piece is movable into and out of contact with the second pole piece on movement of the tube between its first and second positions; and
- an urging means for urging the tube towards its first position.

The invention extends to a circuit breaker which includes the assembly. The circuit breaker may then have a tripping member which is displaced by the first pole piece upon movement thereof into contact with the second pole piece, the tripping member then interacting with a tripping mechanism of the circuit breaker.

It will be appreciated that the tube will be urged away from the second pole piece. This may be accomplished by a further spring, or by means of the tripping member, the tripping member being in contact with the first pole piece and being urged in some manner so as to urge the tube away from the second pole piece.

The assembly may further have a bobbin on which the coil is wound and in which the tube slides. The magnetic circuit defining means may then comprise an "O"-shaped magnetic frame, the second pole piece forming part thereof.

The retarding fluid may be in liquid form.

The first pole piece may conveniently be used to close off the tube in an hermetically sealed manner.

It will be appreciated that movement of the tube in one direction will be limited by the second pole piece. Movement of the tube in the other direction may conveniently be limited by having the first pole piece sufficiently large so that it engages the bobbin.

The tube may be supported within the bobbin in a low-friction manner thereby to facilitate sliding movement of the tube in the bobbin.

It will be appreciated by those skilled in the art that circuit breakers have previously utilised an armature which is attracted to the pole piece with movement of the armature tripping the switching mechanism of the circuit breaker. With the assembly of the invention the armature is eliminated and a larger force is provided for displacing a tripping component of the breaker.

BRIEF DESCRIPTION OF THE DRAWINGS

The invention is now described by way of an example with reference to the accompanying drawings in which.

DETAILED DESCRIPTION OF THE DRAWINGS

Figure 1:
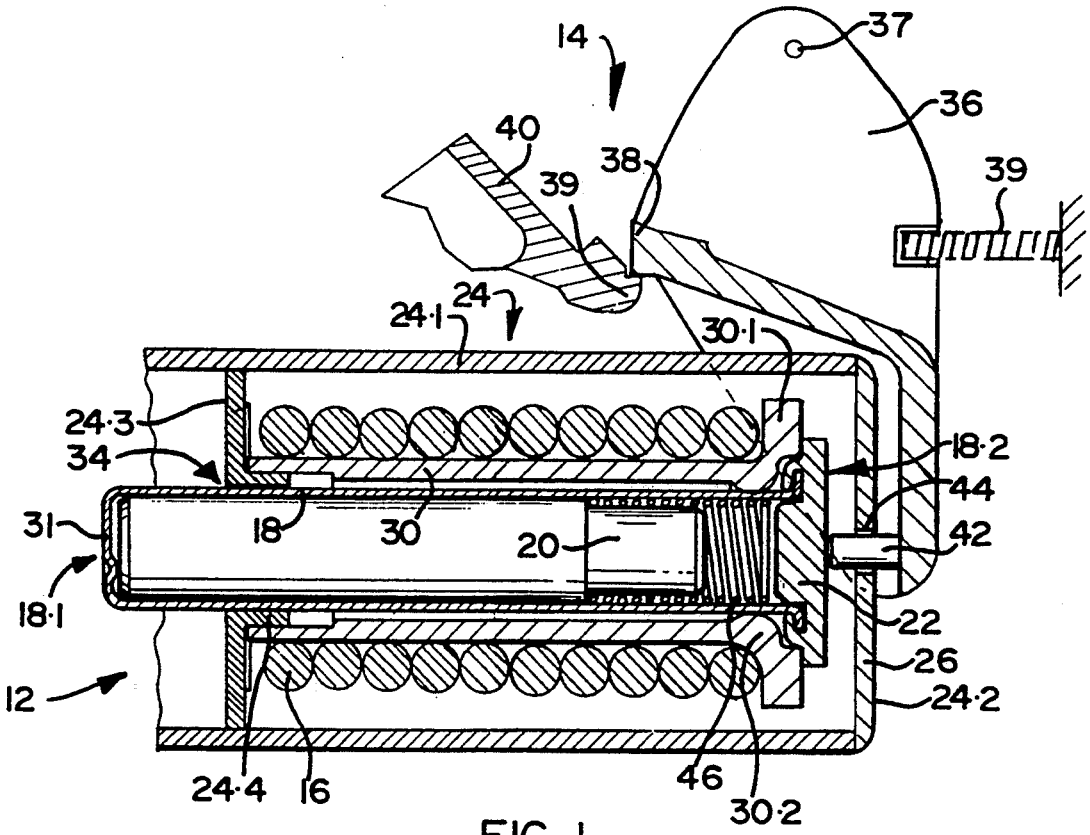
FIG. 1 shows schematically a current monitoring assembly in accordance with the invention together with a portion of the tripping mechanism of a circuit breaker in their normal operative configuration.

Referring to the drawings, a part of a circuit breaker is indicated generally. The breaker includes a current monitoring assembly 12 and a tripping mechanism 14 (which is partly shown).

The current monitoring assembly 12 includes a coil 16, a tube 18 slidably mounted in the coil 16, a core 20 slidably housed within the tube 18, a first pole piece 22 mounted on the tube 18 and a magnetic circuit defining means in the form of an "O"-shaped magnetic frame 24 having a second pole piece 26 aligned with the first pole piece 22.

The tube 18 is of a non-magnetic material such as brass or plastic and the core 20 is of a magnetic material.

The frame 24 has a cylindrical body 24.1 which is closed off at one end by a cap 24.2 which forms the second pole piece 26. Within the body 24.1 there is a plug 24.3 which has a boss 24.4 that faces towards the cap 24.2. The boss 24.4 defines a central opening 34.

The coil 16 is wound on a bobbin 30 which is supported by the boss 24.4. The bobbin 30 is of plastic.

The tube 18 is slidably mounted within a passage defined by the boss 24.4 and the bobbin 30. The tube 18 is longer than the bobbin 30 so that a first end 18.1 projects through the plug 24.3 and a second opposed end 18.2 projects beyond the bobbin 30. The tube 18 is closed at its end 18.1 by an end wall 31. The other end 18.2 is closed by the first pole piece 22 which is hermetically sealed with the mouth of the tube 18 to close it. The first pole piece 22 is suitably large so that it engages an end flange 30.1 of the bobbin 30 thereby to limit movement of the tube 18 into the bobbin 30. The tube 18 is supported at its end 18.1 by the boss 24.4 and at its other end 18.2 by an internal rib 30.2 in the bore of the bobbin 30, in a low-friction manner.

The core 20 is housed within the tube 18. The core 20 is shorter than the tube 18 and slightly smaller so that it is slidable within the tube. The core 20 is urged towards the end 18.1 of the tube 18 by means of a spring 46 which is located between the core 20 and the first pole piece 22. The tube 18 also contains a damping liquid (not shown) which has a suitable viscosity.

Figure 2:
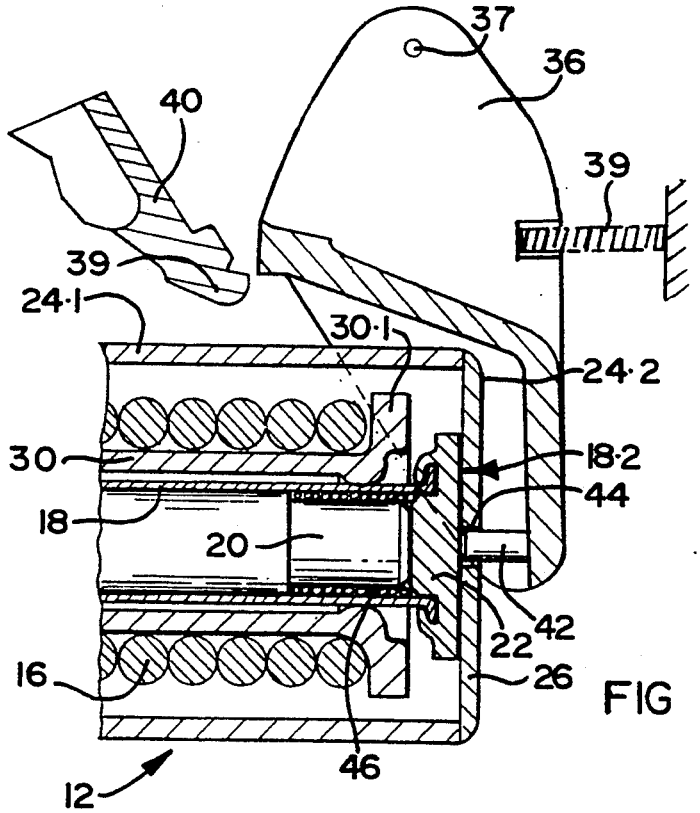
FIG. 2 shows the assembly and the portion of the tripping mechanism in an overload tripping configuration.

Movement of the tube 18 out of the bobbin 30 is limited by the second pole piece 26. Thus, the tube 18 is movable between a first position in which the first pole piece 22 is in contact with the end flange 30.1 of the bobbin 30 (as shown in FIG. 1) and a second position in which the first pole piece 22 is in contact with the second pole piece 26 (as shown in FIG. 2).

The tripping mechanism 14 includes a trip lever 36 which is pivotally mounted about a pivotal axis 37 and has a detent 38 at one end engageable with a complementary shoulder formation on a pivotal operating member 40. The other end of the lever 36 is provided with a pin 42 which extends through the second pole piece 26 via an opening 44 defined therein. The pin 44 engages the first pole piece 22. A compression spring 39 urges the lever 36 in a clockwise direction thereby urging the first pole piece 22 and the tube 18 into the bobbin 30. When the tube 18 is in its first position the lever 36 is such that the detent 38 engages the shoulder formation 39. When the tube 18 is in its second position the first pole piece 22 displaces the pin 42 and the lever 36 into a position in which the member 40 is released (as shown in FIG. 2) so that the tripping mechanism may operate to trip the circuit breaker.

Those skilled in the art will appreciate that, in use, the coil 16 carries the load current of the circuit breaker. If the coil 16 carries a current below the rated value of the circuit breaker the core 20 and the first pole piece 22 do not experience a magnetic force sufficient to displace them against the action of the spring 46 and the force exerted on the lever 36, respectively. Under moderate overload conditions, the core 20 moves towards the first pole piece 22 with a speed which is determined by the magnitude of the current and the viscosity of the damping liquid. When the gap between the core 20 and the first pole piece 22 is completely closed the first pole piece 22 is attracted to the second pole piece 26 with a force sufficient to displace the trip lever 36, causing tripping of the circuit breaker with a time delay.

In a short circuit situation, the force attracting the first pole piece 22 to the second pole piece 26 is large enough to displace the trip lever, even before the core 20 starts to close, causing instantaneous tripping of the circuit breaker 10.

The circuit breaker 10 described and illustrated above does not require a pivotal armature. This simplifies manufacture of the circuit breaker and consequently reduces the cost thereof. Furthermore, the circuit breaker 10 provides a greater electromagnetic tripping force, at the same current, than prior art devices which make use of a pivotal armature.

I claim:

1. A current monitoring assembly which includes a tube that is of a non-magnetic material and which is slidably mounted to be movable between first and second positions;

a coil around the tube;

a core within the tube, the core being of a magnetic material and being slidably housed within the tube;

a retarding fluid contained in the tube for retarding movement of the core;

a core spring within the tube for urging the core towards a first end of the tube;

a first pole piece mounted on the tube at a second end thereof;

a magnetic circuit defining means, for defining a magnetic circuit around the coil, which has a second pole piece aligned with the first pole piece and being positioned relative to the first pole piece such that the first pole piece is movable into and out of contact with the second pole piece on movement of the tube between its first and second positions; and an urging means for urging the tube towards its first position.

2. The assembly of claim 1, which includes a bobbin, the coil being carried by the bobbin and the tube being slidable therein.

3. The assembly of claim 1, in which the magnetic circuit defining means comprises a magnetic frame, the second pole piece forming part thereof.

4. The assembly of claim 1, in which the tube is hermetically sealed.

5. The assembly of claim 2, in which the first pole piece is sufficiently large to engage the bobbin and limit movement of the tube away from the second pole piece.

6. A circuit breaker, which includes a current monitoring assembly as claimed in claim 1; and a tubing mechanism having a tripping member that is displaced by the tube upon movement thereof from its first position to its second position.

7. The circuit breaker as claimed in claim 6, in which the first pole piece engages the tripping member.

8. The circuit breaker as claimed in claim 7, in which the second pole piece has an opening and the tripping member extends therethrough.

* * * * *

UNITED STATES PATENT AND TRADEMARK OFFICE

CERTIFICATE OF CORRECTION

PATENT NO. : 5,343,178

DATED : August 30, 1994

INVENTOR(S) : Dante BAGALINI, et al.

It is certified that error appears in the above-identified patent and that said Letters Patent is hereby corrected as shown below:

On the title page:

ITEM [75] ADD AS ADDITIONAL INVENTORS:

ALAN G. SUGDEN
KEMPTON PARK, SOUTH AFRICA

DANNY HADARY
JOHANNESBURG, SOUTH AFRICA

Signed and Sealed this

Second Day of July, 1996

Bruce Lehman

*Attest:*

BRUCE LEHMAN

*Attesting Officer*

*Commissioner of Patents and Trademarks*